US007646677B2

(12) United States Patent
Nakamura

(10) Patent No.: US 7,646,677 B2
(45) Date of Patent: Jan. 12, 2010

(54) PORTABLE ELECTRONIC TIMEPIECE

(75) Inventor: Hisao Nakamura, Chiba (JP)

(73) Assignee: Seiko Instruments Inc. (JP)

( * ) Notice: Subject to any disclaimer, the term of this patent is extended or adjusted under 35 U.S.C. 154(b) by 199 days.

(21) Appl. No.: 11/899,663

(22) Filed: Sep. 6, 2007

(65) Prior Publication Data

US 2008/0062820 A1 Mar. 13, 2008

(30) Foreign Application Priority Data

Sep. 7, 2006 (JP) ..... 2006-242879

(51) Int. Cl.
*G04C 17/00* (2006.01)
*G04B 18/00* (2006.01)

(52) U.S. Cl. ..... 368/69; 368/185

(58) Field of Classification Search ..... 368/69, 368/185–187

See application file for complete search history.

(56) References Cited

U.S. PATENT DOCUMENTS

| | | | | |
|---|---|---|---|---|
| 4,092,821 | A * | 6/1978 | Wirz | 368/204 |
| 4,170,104 | A | 10/1979 | Yamagata | 58/23 |
| 4,545,647 | A | 10/1985 | Sasaki et al. | 350/331 |
| 6,625,087 | B2 * | 9/2003 | Paratte | 368/69 |
| 6,955,552 | B2 * | 10/2005 | Ferri et al. | 439/188 |
| 7,210,845 | B2 * | 5/2007 | Oesch et al. | 368/320 |

FOREIGN PATENT DOCUMENTS

| | | |
|---|---|---|
| EP | 0845718 | 6/1998 |
| JP | 53125072 | 1/1978 |
| JP | 2005 214795 | 8/2005 |
| JP | 2005214795 | 8/2005 |

* cited by examiner

*Primary Examiner*—Felix O Figueroa
*Assistant Examiner*—Thanh S Phan
(74) *Attorney, Agent, or Firm*—Adams & Wilks

(57) ABSTRACT

To provide a portable electronic timepiece capable of downsizing a product without reducing a display area. Zebra rubbers are respectively fixed attached to left and right side faces of a contact member attached portion of a case by making a fixed contact portion constituting a button shaft opposed face thereof disposed on an extension of a button shaft and bringing a section connecting portion thereof into contact with connecting patterns of a contact/main board connecting portion of a main board. When the button shaft is inserted into a button shaft guide hole, a front end thereof is brought into contact with a surface of a bowl type rubber switch member having a section in a channel-like shape. At the same time, the operating button is contained in a button containing recess portion formed at an outer peripheral portion of the case may be to a degree of capable of forming the button containing recess portion, and therefore, downsizing a product is not influenced by the thickness of the outer peripheral portion of the case.

10 Claims, 6 Drawing Sheets

PORTABLE ELECTRONIC TIMEPIECE

BACKGROUND OF THE INVENTION

1. Field of the Invention

The present invention relates to a module of an electronic timepiece.

2. Description of the Related Art

An electronic timepiece including a digital display portion is constituted generally by containing a timepiece module including a liquid crystal panel constituting a display element and a main board in a case. The main board is constituted by mounting an electronic part of IC or the like to a printed circuit board, and is provided with various functions of a time display function for displaying current time in digital at the liquid crystal panel based on an oscillation frequency of a quartz oscillator, an alarm function of generating an alarm based on alarm setting and the like. The printed circuit board is arranged with a contact portion, and an outer peripheral portion of the timepiece case is arranged with an operating portion including an operating button and a button shaft. The contact portion and the operating portion constitute a switch mechanism.

The operating portion is provided with an operating spring, and the operating spring functions to separate a front end of the button shaft from the contact portion. The contact portion is a normal off contact, and a switching mechanism is a normal off switch. Hence, in setting time or setting alarm or the like, a user pushes the operating button against the operating spring. Then, the front end of the button shaft pushes the contact portion to switch the contact portion to an on state. In this way, the user carries out a predetermined input by pertinently operating the operating button while looking at a set screen displayed on the display panel.

As described in JP-A-2005-214795 (Patent Reference 1), an electronic timepiece of a background art including a digital display portion needs a thickness for forming a guide hole for sliding to guide the button shaft of the operating portion at an outer peripheral portion of a case other than a thickness for forming a button containing recess portion. That is, the button containing recess portion for containing the operating button of the operating portion is formed at an outer peripheral face of the case, at the same time, a through hole constituting the guide hole is formed between a bottom face of the button containing recess portion and an inner peripheral face of the timepiece case. Therefore, although a thickness of an outer peripheral portion of the case arranged with the operating portion, that is, an interval between the outer peripheral face and the inner peripheral face thereof is more or less shorter than a sum of a length of a button shaft and a height of the operating button, the interval constitutes a considerable thickness in comparison with that of a case of a general electronic apparatus. Further, according to the electronic timepiece of the background art including the digital display portion, the contact portion is arranged at a vicinity of an outer peripheral portion of a display area, and therefore, a space for arranging the contact portion is needed between the outer peripheral portion of the case and the vicinity of the outer peripheral portion of the display area.

According to the electronic timepiece of the background art including the digital display portion, although a size of the case needs to be reduced in order to downsize a product, since the guide hole for sliding to guide the button shaft of the operating button needs to be formed, the thickness of the outer peripheral portion of the case cannot be thinned. Therefore, according to the electronic timepiece of the background art including the digital display portion, downsizing a product is necessarily accompanied by downsizing the display area. Further, when downsizing the display area reduces a product value, the product cannot be downsized.

It is a problem of the invention to be resolved to provide a portable electronic timepiece capable of downsizing a product without reducing a display area.

SUMMARY OF THE INVENTION

It is an object of the invention to provide a portable electronic timepiece capable of downsizing a product without reducing a display area.

In order to achieve this and other objects the invention comprises a portable electronic timepiece constituted by at least a timepiece module having a main board mounted with an electronic part on a printed circuit board and a display element for displaying time or the like in digital, a case for containing the timepiece module, and a switch mechanism arranged with an operating portion having an operating button at an outer periphery of the case, a button shaft of the operating button is arranged at a position beneath and planarly overlapping the display element, a contact portion of the switch mechanism is arranged on an extension in a direction of sliding the button shaft and at a position planarly overlapping the main board, and the main board and the contact portion are connected in a direction of a section thereof by connecting means.

By the invention, the outer peripheral portion of the case can be thinned to the thickness of only forming the containing a recess containing portion of the push button, therefore, by the invention, the portable electronic timepiece can be downsized without reducing a display area. Further, light-weighted formation of an exterior of the portable electronic timepiece can be achieved by the invention.

DESCRIPTION OF THE PREFERRED EMBODIMENTS

A portable electronic timepiece according to the invention is a portable electronic timepiece constituted by including at least a timepiece module having a main board mounted with an electronic part on a printed circuit board and a display element for displaying time or the like in digital, a case for containing the timepiece module, and a switch mechanism arranged with an operating portion having an operating button at an outer periphery of the case, in which a button shaft of the operating button is arranged at a position planarly overlapping the display element, a contact portion of the switch mechanism is arranged at a position on an extension of a direction of sliding the bottom shaft and planarly overlapping the main board, and the main board and the contact portion are connected by connecting means in a sectional direction.

Embodiment 1

Figure 1:
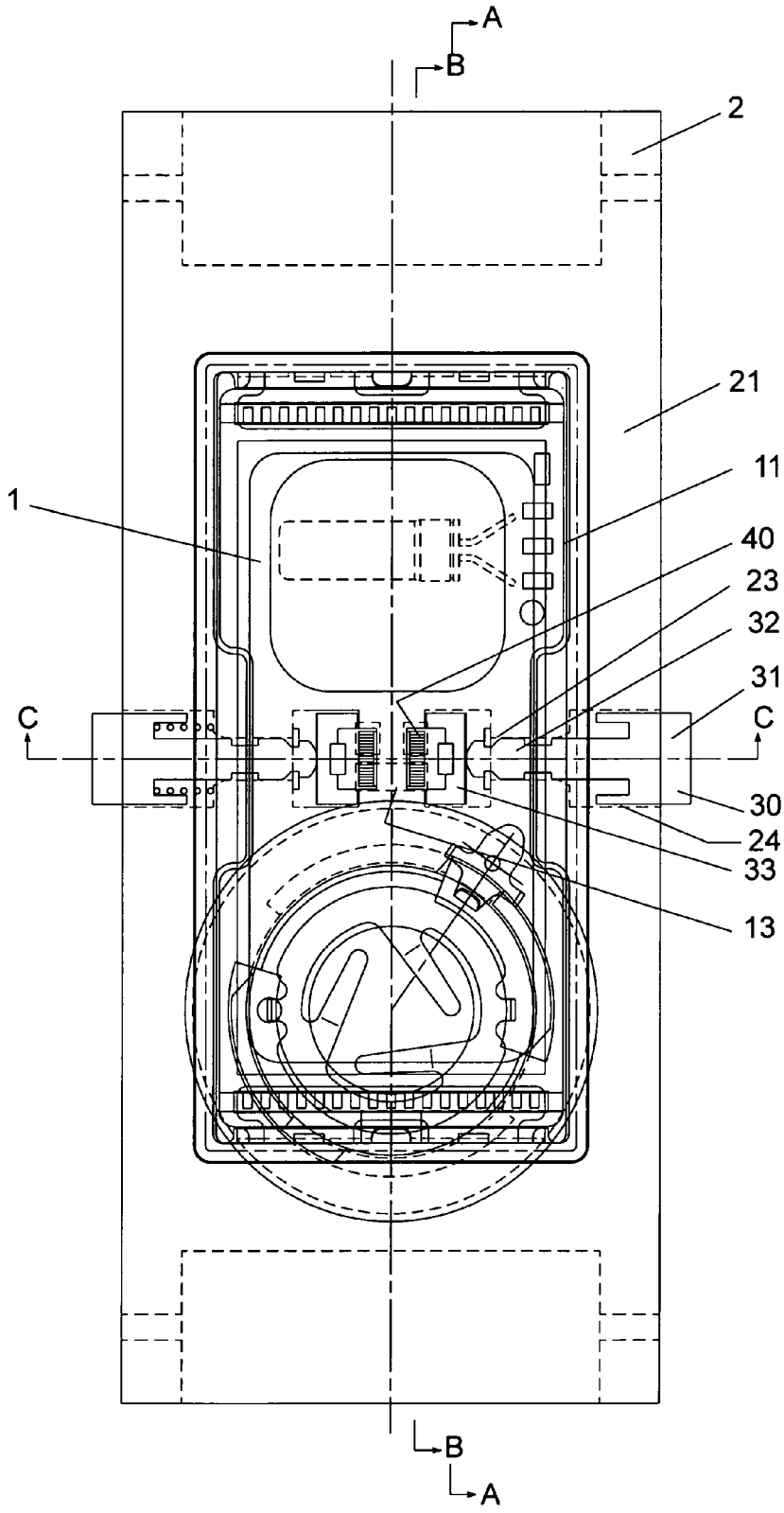
FIG. 1 is a plane view of a portable electronic timepiece of embodiment 1 of the invention.
Figure 2:
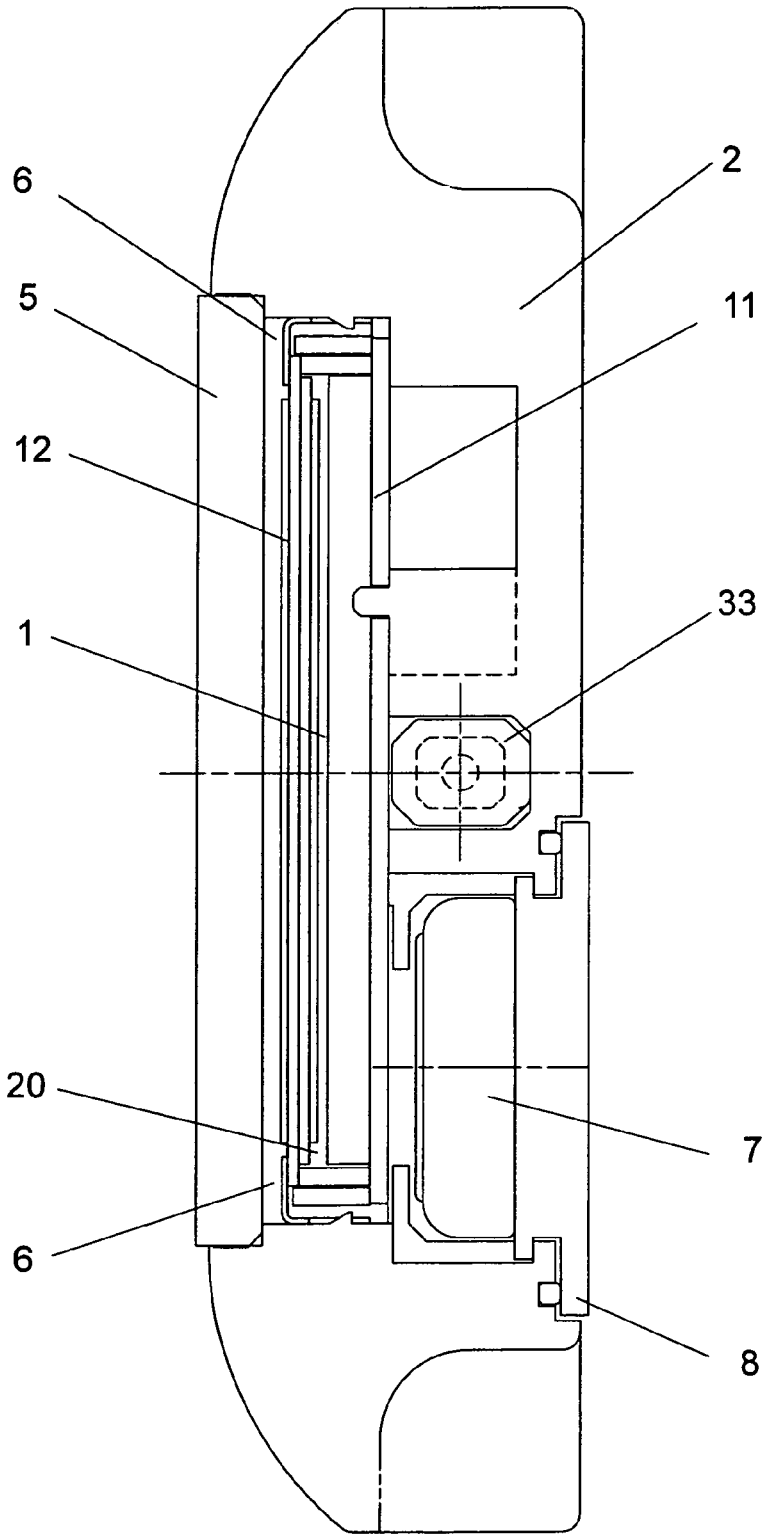
FIG. 2 is a sectional view of the portable electronic timepiece of embodiment 1 of the invention cut by a line A-A of FIG. 1.
Figure 3:
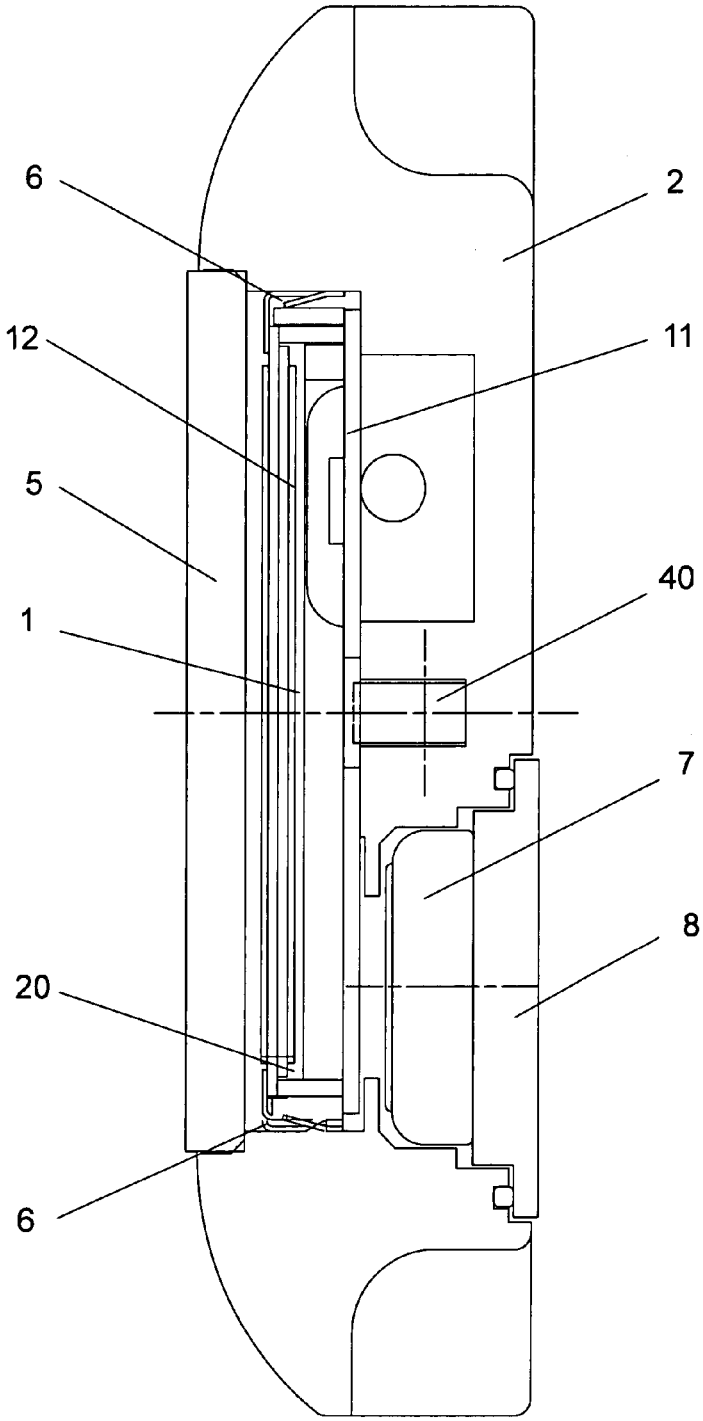
FIG. 3 is a sectional view of the portable electronic timepiece of embodiment 1 of the invention cut by a line B-B of FIG. 1.
Figure 4:
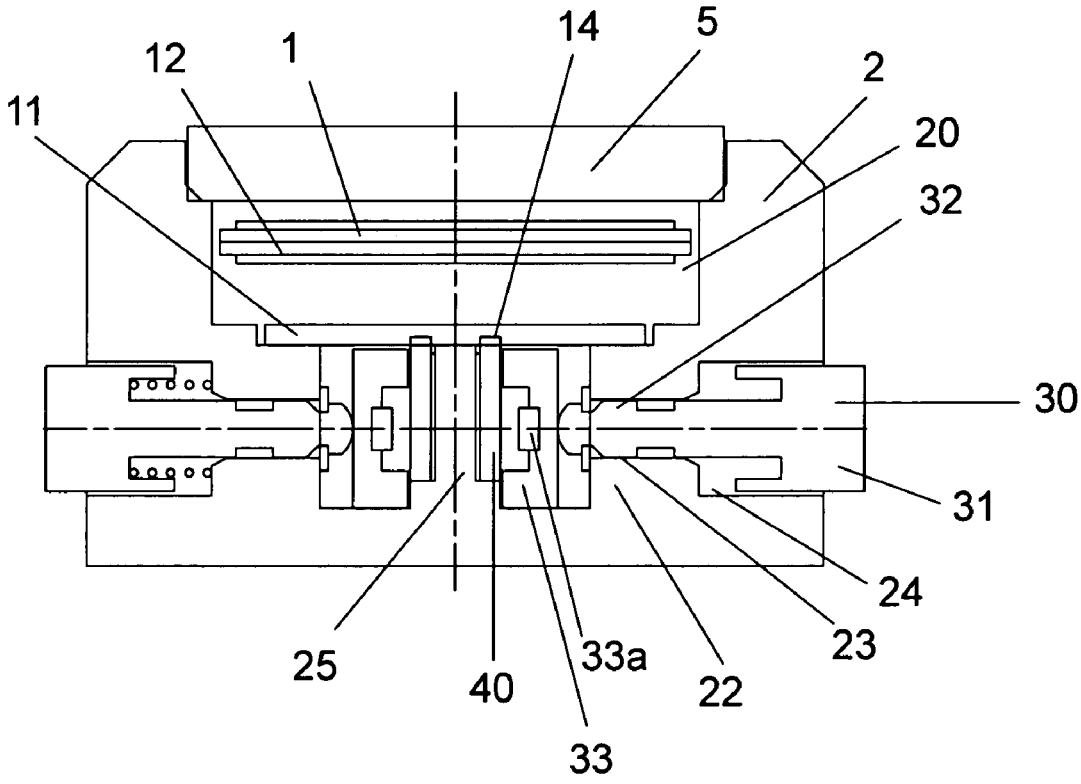
FIG. 4 is a sectional view of the portable electronic timepiece of embodiment 1 of the invention cut by a line C-C of FIG. 1.

As shown by a plane view of FIG. 1, a sectional view of FIG. 2 cut by a line A-A of FIG. 1, a sectional view of FIG. 3 cut by a line B-B of FIG. 1, a sectional view of FIG. 4 cut by a line C-C of FIG. 1, embodiment 1 of the invention is a portable electronic timepiece constituted by including at least a timepiece module 1 including a main board 11 mounted with an electronic part on a printed circuit board and a liquid crystal display element 12 for displaying time or the like in digital, a case 2 for containing the timepiece module 1, and a switch mechanism 3 arranged with an operating portion 30 including an operating button 31 at an outer peripheral portion 21 of the case 2.

The timepiece module 1 is contained in a module containing recess portion 20 of the case 2, and is held at a containing position by a liquid crystal display element holder 6. A top side opening of the case 2 is sealed by a cover glass 5. A battery 7 is contained at a battery containing recess portion formed on a back side of the case, and an opening of the battery containing recess portion is sealed by a battery lid 8.

The outer peripheral portion 21 of the case 2 is formed with push button containing recess portions 24 symmetrically in a left and right direction, and a button shaft guide hole 23 is formed at a button slidingly guide portion forming portion 22 of the case 2. The button slidingly guide portion forming portion 22 is a portion of the case 2 and a portion projected to an inner side of the case 2 from the outer peripheral portion 21, and therefore, is not related to a thickness of the outer peripheral portion 21. Further, the button slidingly guide portion forming portion 22 is constituted by a size of only forming the button shaft guide hole 23, and therefore, it is not necessary to change sizes and positions of the timepiece module 20 and the battery containing recess portion.

Figure 5:
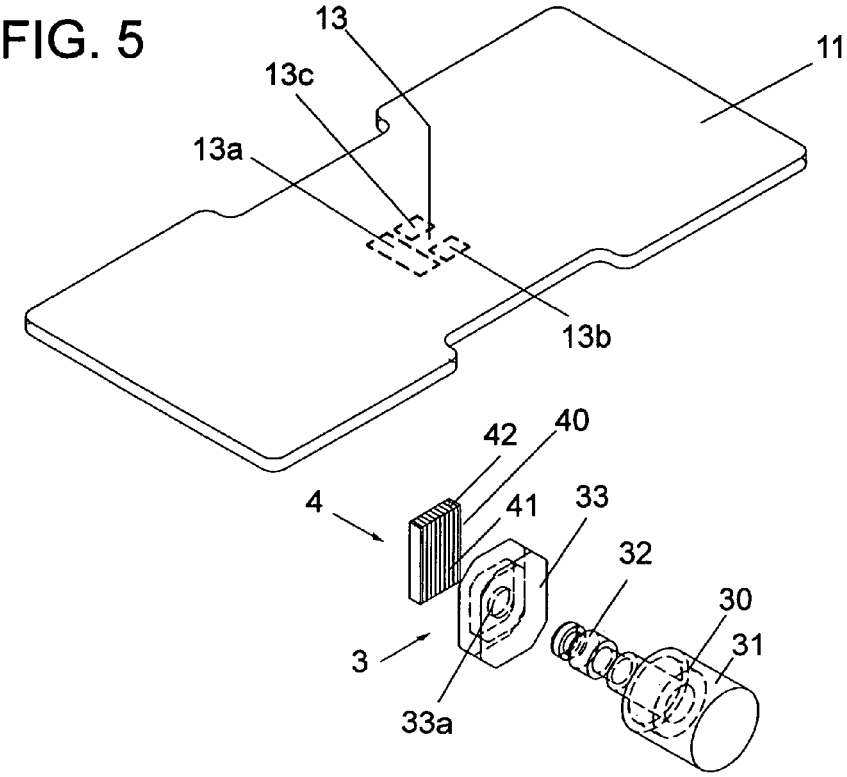
FIG. 5 is a part disassembled view of a portion including a switch mechanism and connecting means adopted in the portable electronic timepiece of embodiment 1 of the invention.

As shown by a part disassembled view of FIG. 5, connecting means 4 for connecting the switch mechanism 3 and the main board of embodiment 1 is constituted by using zebra rubber 40 of a rectangular parallelepiped arranged on an extension in a direction of sliding a button shaft 32 and a lower side of the main board 11, that is, at a position planarly overlapping the main board 11. The zebra rubber 40 is an electrically connecting part constituted by alternately laminating a plurality of conducting rubber plates and a plurality of insulating rubber plates. Or, the zebra rubber 40 is an electrically connecting part providing a plurality of gold wires at three faces or four faces of an outer periphery of silicone rubber of a rectangular parallelepiped at intervals. In FIG. 5, a plurality of conducting portions are exposed at a button shaft opposed face of the zebra rubber 40 opposed to the button shaft 32 at equal intervals, at the same time, the plurality of conducting portions are exposed also at a main board opposed face opposed to a lower face of the main board 11 constituting a face orthogonal to the button shaft opposed face at equal intervals.

The button shaft opposed face of the zebra rubber 40 constitutes a fixed contact portion 41 of the control portion of the switch mechanism 3. A movable contact portion of the contact portion of the switch mechanism 3, that is, a movable contact portion for opening/closing the fixed contact portion 41 is a bowl type rubber switch member 33 having a section in a channel-like shape. A conducting member 33*a* is provided at a center portion of the rubber switch member 33. When the parts are integrated to the case 2, the switch mechanism 3 and the connecting means 4 are simultaneously constituted.

That is, the zebra rubbers 40 are respectively fixedly attached to left and right side faces of a contact member attaching portion 25 of the case 2 by making the fixed contact portions 41 constituting the button shaft opposed faces disposed at positions on the extension of the button shaft 32 and bringing section connecting portions 42 thereof into contact with a circuit pattern comprised of connecting patterns 13*a*, 13*b*, 13*c* of a contact/main board connecting portion 13 of the main board 11. When the button shaft 32 is slidably inserted into the button shaft guide hole 23, a front end thereof is brought into contact with a surface of the bowl type rubber switch member 33 having the section in the channel-like shape. At the same time, the operating button 31 is contained in the button containing recess portion 24 formed at the outer peripheral portion 21 of the case 2. By such a construction, the operating button 31 can be operated to move the button shaft 32 inwardly and outwardly to turn on/off (close/open) the switch member 33.

As described above, according to the portable electronic timepiece of embodiment 1, when the operating portions 30 each having the zebra rubber 40, the operating button 31 and the rubber switch member 33 are arranged at predetermined positions of the case 2, the switch mechanism 3 and the connecting means 4 for connecting the contact portion of the main board are simultaneously constituted. Further, according to the portable electronic timepiece of embodiment 1, a thickness of the outer peripheral portion 21 of the case 2 may be to a degree capable of forming the button containing recess portion 24, and therefore, downsizing a product is not influenced by the thickness of the outer peripheral portion 21 of the case. Therefore, the portable electronic timepiece of embodiment 1 can downsize a product without a display area.

Embodiment 2

A portable electronic timepiece of embodiment 2 of the invention is constructed by a constitution the same as that of embodiment 1 except the connecting means 4 for connecting the switch mechanism 3 and the main board. That is, when the plane view of FIG. 1, the sectional view of FIG. 2 cut by the line A-A of FIG. 1, the sectional view of FIG. 3 cut by the line B-B of FIG. 1, and the sectional view of FIG. 4 cut by the line C-C of FIG. 1 are referred, the portable electronic timepiece of the embodiment of the invention is a portable electronic timepiece constituted by including at least the timepiece module 1 including the main board 11 mounted with an electronic part on the printed circuit board and the display element 12 for displaying time or the like in digital, the case 2 for containing the timepiece module 1, and the switch mechanism 3 arranging the operating portion 30 including the operating button 31 at the outer peripheral portion 21 of the case 2.

Figure 6:
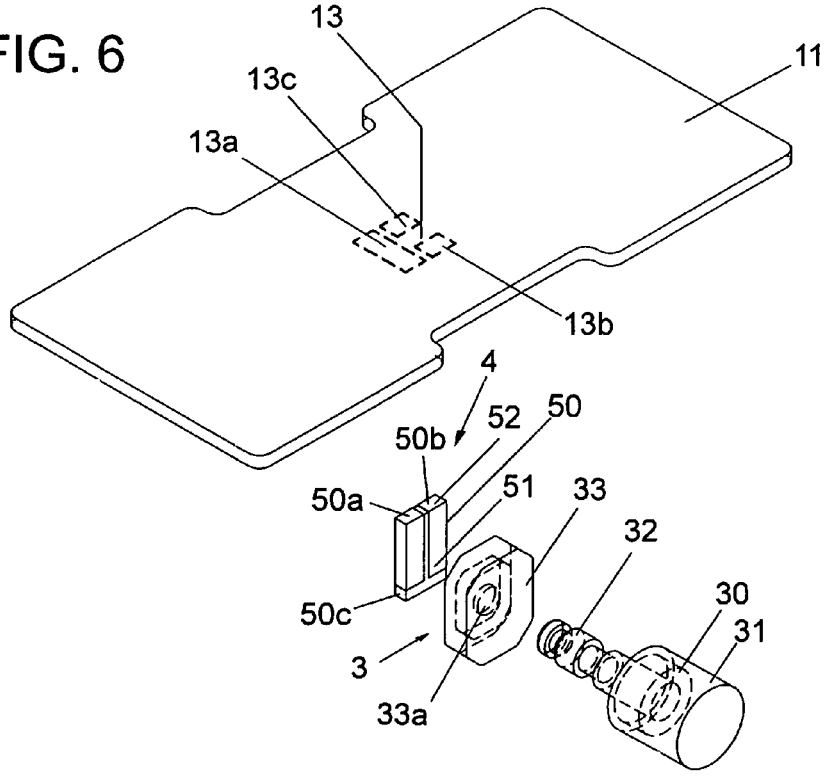
FIG. 6 is a part disassembled view of a portion including a switch mechanism and connecting means adopted in a portable electronic timepiece of embodiment 2 of the invention.

As shown by a part disassembled view of FIG. 6, the connecting means 4 for connecting the switch mechanism 3 and the main board of embodiment 2 is constituted by using a contact member 50 arranged on an extension in a direction of sliding the button shaft 32 and at a lower side of the main board 11, that is, at a position planarly overlapping the main board 11. The contact member 50 is a member integrally molded by interposing a T-like type insulating rubber member 50*c* by a pair of conducting rubbers 50*a*, 50*b* of a rectangular parallelepiped.

Button shaft opposed faces of the pair of conducting rubbers 50*a*, 50*b* of the rectangular parallelepiped of the contact member 50 constitute a fixed contact portion 51 of the contact portion of the switch mechanism 3. A movable contact portion of the contact portion of the switch mechanism 3, that is, a movable contact portion for opening/closing the fixed contact portion 51 is the bowl type rubber switch member 33 having a section in the channel-like shape. The conducting member 33*a* is provided at the center portion of the rubber switch member 33. When the parts are integrated to the case 2, the switch mechanism 3 and the connecting means 4 are simultaneously constituted.

That is, the contact members 50 are respectively fixedly attached to the left and right side faces of the contact member attaching portion 25 of the case 2 by making the fixed contact portions 51 constituting the button shaft opposed faces disposed on the extension of the button shaft 32 and bringing a section connecting portion 52 thereof into contact with the connecting patterns 13*a*, 13*b*, 13*c* of the contact/main board connecting portion 13 of the main board 11. When the button shaft 32 is inserted into the button shaft guide hole 23, the front end is brought into contact with the surface of the bowl type rubber switch member 33 having a section in the channel-like shape. At the same time, the operating button 31 is contained in the button containing recess portion 24 formed at the outer peripheral portion 21 of the case 2.

In sum, the portable electronic timepiece of embodiment 2 is a portable electronic timepiece characterized in that the contact member 50 integrally molded by interposing the T-type insulating rubber member 50*c* by the pair of conducting rubbers 50*a*, 50*b* of the rectangular parallelepiped is arranged on the extension in the direction of sliding the button shaft 32 and at the position planarly overlapping the main board 11, the button shaft opposed face of the contact member 50 is made to constitute the fixed contact portion 51, and the rubber switch member 33 switched on/off by the front end of the button shaft 32 is made to constitute the movable contact portion, further, the section connecting face 52 of the conducting rubbers 50*a*, 50*b* orthogonal to the button shaft opposed face of the contact member 50 is made to constitute connecting means for connecting the main board and the contact portion.

According to the portable electronic timepiece of embodiment 2, when the contact member 50 integrally molded by interposing the T-type insulating rubber member 50*c* by the pair of conducting rubbers 50*a*, 50*b* of the rectangular parallelepiped, the operating portion 30 having the operating button 31 and the rubber switch 33 are arranged at predetermined positions of the case 2, the switch mechanism 3 and the connecting means 4 for connecting the contact portion and the main board are simultaneously constituted. Further, according to the portable electronic timepiece of embodiment 2, a thickness of the outer peripheral portion 21 of the case 2 may be to a degree capable of forming the button containing recess portion 24, and therefore, downsizing the product is not influenced by the thickness of the outer peripheral portion 21 of the case. Therefore, also the portable electronic timepiece of embodiment 2 can downsize the product without reduce the display area.

Embodiment 3

A portable electronic timepiece of embodiment 3 of the invention is constructed by a constitution the same as that of embodiment 1 except the connecting means 4 for connecting the switch mechanism 3 and the main board. That is, when the plane view of FIG. 1, the sectional view of FIG. 2 cut by the line A-A of FIG. 1, the sectional view of FIG. 3 cut by the line B-B of FIG. 1, and the sectional view of FIG. 4 cut by the line C-C of FIG. 1 are referred, the portable electronic timepiece is a portable electronic timepiece constituted by including at least the timepiece module 1 including the main board 11 mounted with an electronic part on a printed circuit board and the display element 12 for displaying time or the like in digital, the case 2 for containing the timepiece module 1, and the switch mechanism 3 arranged with the operating portion 30 including the operating button 31 at the outer peripheral portion 21 of the case 2.

Figure 7:
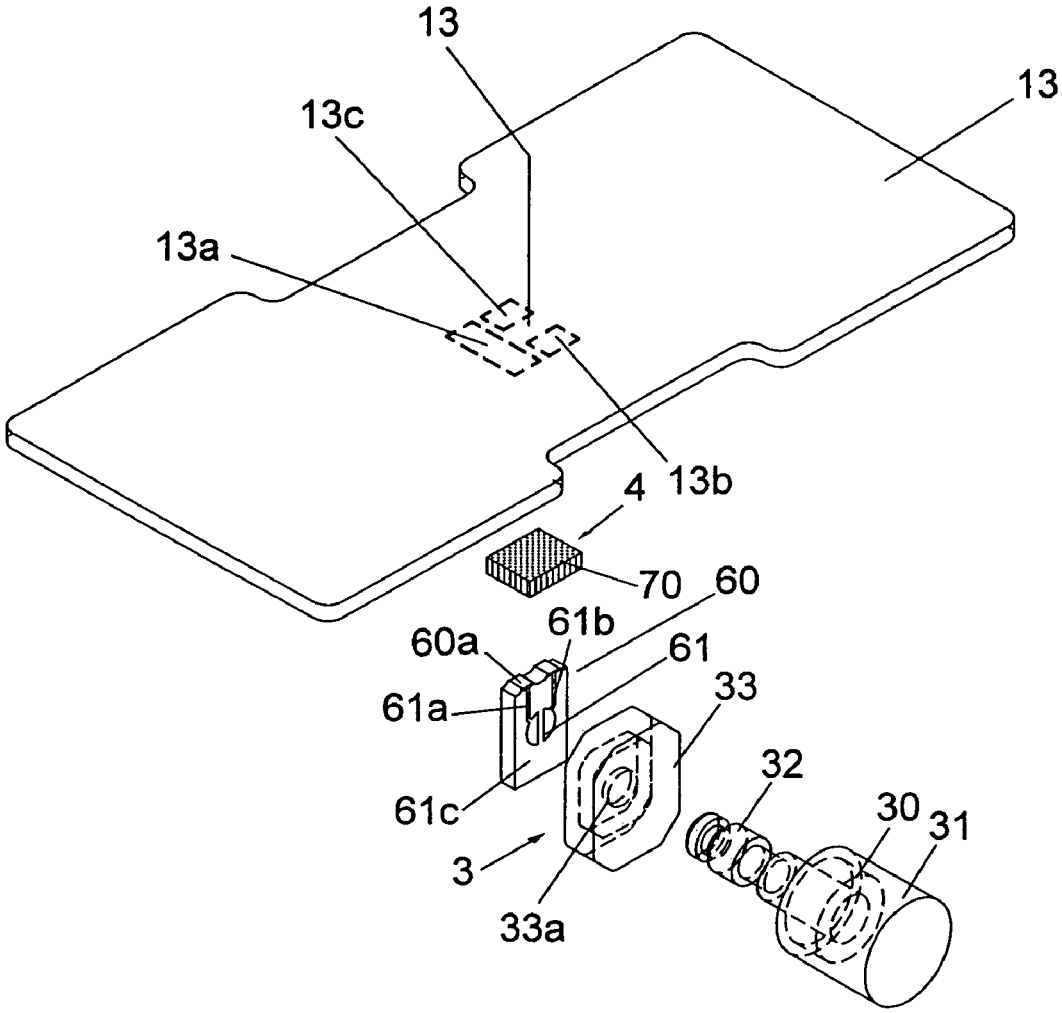
FIG. 7 is a part disassembled view of a portion including a switch mechanism and connecting means adopted in a portable electronic timepiece of embodiment 3 of the invention.

As shown by a part disassembled view of FIG. 7, the connecting means 4 for connecting the switch mechanism 3 and the main board of embodiment 3 is constituted by using a contact member 60 arranged on the extension in the direction of the sliding the button shaft 32 and the lower side of the main board 11, that is, the position planarly overlapping the main board 11 and a conducting rubber member 70 having an electricity conduction anisotropy as connecting means. The connecting member 60 is a member forming a pair of contact patterns 61 and connection line patterns 61*a*, 61*b* extended from the pair of contact patterns 61 to end faces thereof at a printed circuit board 60*a* for constituting the contact portion.

A button shaft opposed face of the contact member 60 formed with the pair of contact patterns 61 constitute a fixed contact portion 61 of the contact portion of the switch mechanism 3. The movable contact portion of the contact portion of the switch mechanism 3, that is, the movable contact portion for opening/closing the fixed contact portion 5l, is the bowl type rubber switch member 33 having a section in a channel-like shape. A conducting member 33*a* is provided at a center portion of the rubber switch member 33. When the parts are integrated to the case 2, the switch mechanism 3 and the connecting means 4 are simultaneously constituted.

That is, the contact members 60 are respectively fixedly attached to the left and right side faces of the contact member attaching portion 25 of the case 2 by making the fixed contact portion 61 formed with the pair of contact patterns disposed at a position on the extension of the button shaft 32, and bringing end faces extended with the connection line patterns 61*a*, 61*b* into contact with the one side face of the conducting rubber member 70 having the electricity conduction anisotropy. One surface of the conducting rubber member 70 having the electricity conduction anisotropy is brought into contact with the connecting patterns 13*a*, 13*b*, 13*c* of the contact/main board connecting portion 13 of the main board 11 and is fixed to the upper face of the contact member attaching portion 25 of the case 2. When the button shaft 32 is inserted into the button shaft guide hole 23, the front end is brought into contact with the surface of the bowl type rubber switch member 33 having a section in the channel-like shape. At the same time, the operating button 31 is contained in the button containing recess portion 24 formed at the outer peripheral portion 21 of the case 2.

In sum, the portable electronic timepiece of embodiment 3 is a portable electronic timepiece characterized in that the contact member 60 formed with the pair of contact patterns 61 at the printed circuit board 60*a* for constituting the contact portion is arranged on the extension in the direction of sliding the button shaft 32 and at the position planarly overlapping the main board 11, the contact pattern 61 of the contact member 60 is made to constitute the fixed contact portion of the contact portion of the switch mechanism 3, and the rubber switch member 33 switched on/off by the front end of the button shaft 32 is made to constitute the movable contact portion of the contact portion of the switch mechanism 3, further, the conducting rubber 70 having the electricity conduction anisotropy is arranged as connecting means for connecting the connection lines 61*a*, 61*b* of the pair of connecting patterns 61 extended at the end face of the contact member 60 and the main board 11.

According to the portable electronic timepiece of embodiment 3, when the contact member 60 forming the pair of contact patterns 61 at the printed circuit board 60*a* for constituting the contact portion, the operating portion 30 including the operating button 31, the conducting rubber 70 having the electricity conduction anisotropy and the rubber switch 33 are arranged at predetermined positions of the case 2, the switch mechanism 3 and the connecting means 4 for connecting the contact portion and the main board are simultaneously constituted. Further, according to the portable electronic timepiece of embodiment 3, a thickness of the outer peripheral portion 21 of the case 2 may be to a degree capable of forming the button containing recess portion 24, and therefore, downsizing the product is not influenced by the thickness of the outer peripheral portion 21 of the case. Therefore, also the portable electronic timepiece of embodiment 3 can downsize the product without reducing the display area. Further, although according to the embodiment, the conducting rubber having the electricity conduction anisotropy is made to constitute the connecting means, a similar effect can be achieved also by connecting means by soldering or conductive adhering, soldering by way of a lead wire.

What is claimed is:

1. A portable electronic timepiece comprising:

a timepiece module having a printed circuit board and a display element that displays time;

a case that contains the timepiece module; and a switch mechanism having an operating button disposed at an outer periphery of the case, a button shaft connected at one end to the operating button and slidably disposed in the case to undergo inward and outward sliding movement beneath the timepiece module, a movable contact portion that is moved inwardly by inward movement of the button shaft and that moves outwardly when the button shaft undergoes outward movement, and a fixed contact portion connected to a circuit pattern on the printed circuit board and disposed to make contact with the movable contact portion when the movable contact portion is moved inwardly by operation of the operating button;

wherein the fixed contact portion comprises a rectangular parallelepiped constituted by alternately laminating a plurality of conducting rubbers and a plurality of insulating rubbers, the movable contact portion comprises a rubber switch member switched on/off by movement of the button shaft, and a face of the rectangular parallelepiped contacts the circuit pattern on the printed circuit board.

2. A portable electronic timepiece according to claim 1; further including another switch mechanism similar to the first-mentioned switch mechanism.

3. A portable electronic timepiece according to claim 2; wherein the operating buttons of the two switch mechanisms are disposed on opposite sides of the case.

4. A portable electronic timepiece comprising:

a timepiece module having a printed circuit board and a display element that displays time;

a case that contains the timepiece module; and a switch mechanism having an operating button disposed at an outer periphery of the case, a button shaft connected at one end to the operating button and slidably disposed in the case to undergo inward and outward sliding movement beneath the timepiece module, a movable contact portion that is moved inwardly by inward movement of the button shaft and that moves outwardly when the button shaft undergoes outward movement, and a fixed contact portion connected to a circuit pattern on the printed circuit board and disposed to make contact with the movable contact portion when the movable contact portion is moved inwardly by operation of the operating button;

wherein the fixed contact portion comprises a contact member integrally molded by interposing a T-type insulating rubber member by a pair of conducting rubbers of a rectangular parallelepiped, the movable contact portion comprises a rubber switch member switched on/off by movement of the button shaft, and a face of the conducting rubber contacts the circuit pattern on the printed circuit board.

5. A portable electronic timepiece according to claim 4; further including another switch mechanism similar to the first-mentioned switch mechanism.

6. A portable electronic timepiece according to claim 5; wherein the operating buttons of the two switch mechanisms are disposed on opposite sides of the case.

7. A portable electronic timepiece comprising:

a timepiece module having a printed circuit board and a display element that displays time;

a case that contains the timepiece module; and a switch mechanism having an operating button disposed at an outer periphery of the case, a button shaft connected at one end to the operating button and slidably disposed in the case to undergo inward and outward sliding movement beneath the timepiece module, a movable contact portion that is moved inwardly by inward movement of the button shaft and that moves outwardly when the button shaft undergoes outward movement, and a fixed contact portion connected to a circuit pattern on the printed circuit board and disposed to make contact with the movable contact portion when the movable contact portion is moved inwardly by operation of the operating button;

wherein the fixed contact portion comprises a contact member having a pair of contact patterns on a printed circuit board, and connecting means for connecting the pair of contact patterns to the circuit pattern on the printed circuit board, and the movable contact portion comprises a rubber switch member switch on/off by movement of the button shaft.

8. A portable electronic timepiece according to claim 7; wherein the connecting means is a conducting rubber having electricity conduction anisotrophy.

9. A portable electronic timepiece according to claim 7; further including another switch mechanism similar to the first-mentioned switch mechanism.

10. A portable electronic timepiece according to claim 9; wherein the operating buttons of the two switch mechanisms are disposed on opposite sides of the case.

* * * * *